US010657933B2

(12) United States Patent
Bora et al.

(10) Patent No.: US 10,657,933 B2
(45) Date of Patent: May 19, 2020

(54) ALGORITHMIC METHOD FOR SPELLING THE PITCHES OF ANY MUSICAL SCALE

(71) Applicant: DOKUZ EYLUL UNIVERSITESI REKTORLUGU, Izmir (TR)

(72) Inventors: Uzay Bora, Izmir (TR); Baris Tekin Tezel, Izmir (TR); Alper Vahaplar, Izmir (TR)

(73) Assignee: DOKUZ EYLUL UNIVERSITESI REKTORLUGU, Izmir (TR)

( * ) Notice: Subject to any disclaimer, the term of this patent is extended or adjusted under 35 U.S.C. 154(b) by 0 days.

(21) Appl. No.: 16/478,145

(22) PCT Filed: Jan. 16, 2018

(86) PCT No.: PCT/TR2018/050013
§ 371 (c)(1),
(2) Date: Jul. 16, 2019

(87) PCT Pub. No.: WO2019/004955
PCT Pub. Date: Jan. 3, 2019

(65) Prior Publication Data

US 2019/0371286 A1 Dec. 5, 2019

(30) Foreign Application Priority Data

Jan. 16, 2017 (TR) ..... a 2017 00645
Nov. 3, 2017 (TR) ..... a 2017 17234

(51) Int. Cl.
*G10G 3/04* (2006.01)

(52) U.S. Cl.
CPC ..... *G10G 3/04* (2013.01); *G10H 2210/066* (2013.01)

(58) Field of Classification Search
CPC ..... G10G 3/04; G10H 2210/066
See application file for complete search history.

(56) References Cited

U.S. PATENT DOCUMENTS 4,479,416 A * 10/1984 Clague ..... G10G 3/04 84/462
5,675,100 A * 10/1997 Hewlett ..... G10G 3/04 84/462
6,831,219 B1 12/2004 Furgis
7,335,834 B2 * 2/2008 Gayama ..... G10G 3/04 84/609
7,482,530 B2 * 1/2009 Kobayashi ..... G10G 3/04 382/239
2004/0216586 A1 * 11/2004 Meredith ..... G10G 3/04 84/645
2019/0371286 A1 * 12/2019 Bora ..... G10G 3/04

FOREIGN PATENT DOCUMENTS

GB 2400485 A 10/2004

OTHER PUBLICATIONS

David Meredith. Comparing Pitch Spelling Algorithms on a Large Corpus of Tonal Music. Computer Music Modeling and Retrieval. Jan. 1, 2005, pp. 173-192, vol. 3310. Springer Berlin Heidelberg, Berlin, Heidelberg.
David Meredith. Optimizing Chew and Chen's Pitch-Spelling Algorithm. Computer Music Journal. May 17, 2007. pp. 54-72, vol. 31, No. 2.

* cited by examiner

*Primary Examiner* — Robert W Horn
(74) *Attorney, Agent, or Firm* — Bayramoglu Law Offices LLC

(57) ABSTRACT

The invention is an algorithmic method that can be used for the fundamental task of optimally spelling the pitches of any given musical scale. The method consists of generating all potential solutions containing all possible spellings for the pitch classes in a given input sequence (numbers of which represent any randomly compiled subset of the chromatic scale), and subjecting them to five filtering stages to find the correct solution. The invention can be used in spelling all possible scales that can be derived from the chromatic scale, in addition to conventional major and minor scales.

10 Claims, No Drawings

ALGORITHMIC METHOD FOR SPELLING THE PITCHES OF ANY MUSICAL SCALE

CROSS REFERENCE TO RELATED APPLICATIONS

This application is the national phase entry of International Application PCT/TR2018/050013, filed on Jan. 16, 2018 which is based upon and claims priority to Turkish Patent Applications No. 2017/00645, filed on Jan. 16, 2017, and No. 2017/17234, filed on Nov. 3, 2017, the entire contents of which are incorporated herein by reference.

TECHNICAL FIELD

The invention is about an algorithmic method that can be used in spelling thousands of scales that can be derived from the chromatic scale alongside hundreds of known scales, in addition to conventional major and minor scales.

BACKGROUND

In the known state of art, US20040216586 A1, U.S. Pat. Nos. 6,831,219 B1 and 5,675,100 A patent documents have been encountered. In the patent document numbered US20040216586 A1; an algorithmic method called ps13 is described. The subject method calculates the correct pitch name of the notes in tonal musical passages, given the start time and the MIDI note number for each note in the passage only. The pitch name prediction with the method has 99.33% accuracy. In the patent document numbered U.S. Pat. No. 6,831,219 B1; an alternative system related to chromatic music notation. This system is based on the correlation of colours to the tones of a musical scale. In the patent document numbered U.S. Pat. No. 5,675,100 A; a system and method related to music printing information by making an improvement on the classic MIDI standard is described.

On the account of spelling the pitches, there is no method for scales other than the major and minor scales established in music theory. Additionally, determination of the convenience of the spellings of those other scales by subjective decisions, different spellings for the same scale in different publications and this causing an inconsistency especially in the publications aiming at compiling and publishing musical scale types are the present issues in the art.

In the computerized usage in the prior art, aiming at the notation of the five pitches other than the natural ones, either all of them were being shown as sharp or flat, or a fixed setting to cause generally incorrect results was determining which of the five would be shown as sharp or flat. Applications in which one could choose a major/minor tonality could only notate the chosen major or minor scale properly.

With the subject invention, a general method has been created which provides for the spelling of the pitches of thousands of scales that can be arbitrarily chosen as subsets of the chromatic scale alongside hundreds of known scales, in addition to conventional major and minor scales, and a computer application has been also made. Thereby, a solution that can eliminate the above listed issues is set forth.

SUMMARY

With the invention, a general method is set forth from which every interested person from music professionals to amateurs can benefit in order to automatically notate any kind of unfamiliar scale with correct spellings, e.g. when either constructing it on the staff from scratch, or having discovered it on an instrument, or just having heard it, in addition to the notation of hundreds of known scales as well as the conventional major and minor scales. Thereby, an unattended area in regard to music theory is remedied and a referable method for also music publishing of particular content is provided by means of the invention. Furthermore, the invention has the potential to develop a standardization for the notation of any kind of scale.

DETAILED DESCRIPTION OF THE EMBODIMENTS

Basic Operation ('Default' Use)

The scale input to be spelled is given as a sequence of unique pitch-class numbers to cycle once through the octave in ascending direction (for example, such as 4, 6, 7, 9, 11, 1, 3) and this ordered list (input) is defined as follows:

$$S=\{s_1,s_2,\ldots,s_n\}$$

$$s_i\in[0,11];\ i=1,2,\ldots,n;\ n\in[1,12]$$

MIDI "note numbers" can also be used as input and these too are arranged as a "list of pitch-class numbers" after converting by mod 12 operation.

As is shown in the matrix in Table 1, five different pitch classes can be represented using each letter name. In table 2, the elements of the matrix are replaced with numbers showing their pitch-class equivalents.

TABLE 1

Matrix containing possible variety of pitch classes each letter name can represent $$\begin{bmatrix} C\flat\flat & D\flat\flat & E\flat\flat & F\flat\flat & G\flat\flat & A\flat\flat & B\flat\flat \\ C\flat & D\flat & E\flat & F\flat & G\flat & A\flat & B\flat \\ C & D & E & F & G & A & B \\ C\sharp & D\sharp & E\sharp & F\sharp & G\sharp & A\sharp & B\sharp \\ C\times & D\times & E\times & F\times & G\times & A\times & B\times \end{bmatrix}$$

TABLE 2

Elements of the matrix in Table 1 replaced with equivalent pitch-class numbers $$\begin{bmatrix} 10 & 0 & 2 & 3 & 5 & 7 & 9 \\ 11 & 1 & 3 & 4 & 6 & 8 & 10 \\ 0 & 2 & 4 & 5 & 7 & 9 & 11 \\ 1 & 3 & 5 & 6 & 8 & 10 & 0 \\ 2 & 4 & 6 & 7 & 9 & 11 & 1 \end{bmatrix}$$

The procedure consists of the operations leading to the best mapping of the input sequence (list) onto the matrix in Table 2. There are often a vast number of possibilities for this 'mapping' (P), each of which can be called a "path" (pj). All these possible paths are defined as follows:

$$P=\{p_1,p_2,\ldots,p_j,\ldots,p_m\}\ j=1,2,\ldots,m;\ m\in[1,\infty]$$

$$p_j=\{(r_1,c_1),(r_2,c_2),\ldots,(r_n,c_n)\}\ r_i\in[0,4];\ c_i\in[0,6];\ i=1,2,\ldots,n;\ n\in[1.12]$$

Two rules are used when generating all the possible paths: No more than two matches can be chosen on the same matrix column and if two matches are to be chosen on the same column, these should be adjacent.

In order to find the best path, a search is performed by eliminating the candidates through five different heuristically devised filtering stages. The next stage is proceeded only if there is more than one 'winner' after the previous stage.

In the first stage, the path which uses the maximum number of different columns of the matrix is searched. This is a specific procedure for spelling the pitches of a scale, contrary to the procedures handling music passages containing also pitches outside the current chord/scale. Since all the elements of the input sequence are to be treated as scale degrees, they should be notated using different letter names as much as possible. This way, a diatonic representation is favored over a chromatic one. The procedure for the first stage is as follows:

$$P_{stage_1} = \max_{P}\left\{n - \sum_{i=1}^{n-1}\sum_{j=i+1}^{n}\alpha_{ij}\right\}$$

$$\alpha_{ij} = \begin{cases} 1 & c_i = c_j \\ 0 & c_i \neq c_j \end{cases}$$

In the second stage, the path containing the minimum number of augmented or diminished intervals is looked for. To find this, the type of interval between every couple of elements in each path is checked and a penalty score counting the number of the extreme intervals is calculated, then the path with the lowest score is chosen. While counting the penalty points, it is also taken into account 'how extreme' the intervals are (Here, the term 'extreme' is used since in music theory the "minor", "major" and "perfect" intervals are accepted to be usual and the "augmented" and "diminished" intervals are accepted to be unusual, extreme). The calculation of this score and the procedure in the second stage can be defined as follows:

$$P_{stage_2} = \min_{P_{stage_1}}\left\{\sum_{i=1}^{n-1}\sum_{j=i+1}^{n}\phi_{ij}\right\}$$

$$\phi_{ij} = \begin{cases} 1 & \Delta c_{ij} = 0 \\ \Delta s_{ij} - 2\Delta c_{ij} & \Delta c_{ij} \in \{1, 2\} \text{ and } \Delta s_{ij} > 2\Delta c_{ij} \\ 2\Delta c_{ij} - 1 - \Delta s_{ij} & \Delta c_{ij} \in \{1, 2, 3, 4\} \text{ and } \Delta s_{ij} < 2\Delta c_{ij} - 1 \\ \Delta s_{ij} - 2\Delta c_{ij} + 1 & \Delta c_{ij} \in \{3, 4, 5, 6\} \text{ and } \Delta s_{ij} > 2\Delta c_{ij} - 1 \\ 2\Delta c_{ij} - 2 - \Delta s_{ij} & \Delta c_{ij} \in \{5, 6\} \text{ and } \Delta s_{ij} < 2\Delta c_{ij} - 2 \\ 0 & \text{otherwise} \end{cases}$$

$$\Delta c_{ij} = \begin{cases} c_i - c_j & c_i \geq c_j \\ c_i - c_j + 7 & c_i < c_j \end{cases}$$

$$\Delta s_{ij} = \begin{cases} s_i - s_j & s_i \geq s_j \\ s_i - s_j + 12 & s_i < s_j \end{cases}$$

The next two stages are based on preferring the minimum use of accidentals (sharps, flats, etc).

In the third stage, path/paths containing the maximum number of naturals are preferred. The definition of the third stage is as follows:

$$P_{stage_3} = \max_{P_{stage_2}}\left\{\sum_{i=1}^{n}\eta_i\right\} \text{ where } \eta_i = \begin{cases} 1 & r_i = 2 \\ 0 & r_i \neq 2 \end{cases}$$

In the fourth stage, path/paths containing the minimum number of double flats and double sharps are preferred. The definition of the fourth stage is as follows:

$$P_{stage_4} = \min_{P_{stage_3}}\left\{\sum_{i=1}^{n}\omega_i\right\} \text{ where } \omega_i = \begin{cases} 1 & r_i \in \{0, 4\} \\ 0 & r_i \notin \{0, 4\} \end{cases}$$

In the final stage, it is checked among the remaining paths if there are paths having a pitch with a sharp sign between two naturals that are two semitones apart, to favor them over those paths having a flat sign between the same naturals. For this purpose, paths having the maximum number of sharp signs between such naturals are chosen.

The fifth stage can be defined as follows:

$$P_{stage_5} = \max_{P_{stage_4}}\left\{\sum_{i=1}^{n}\theta_i\right\}$$

$$\theta_i = \begin{cases} 1 & r_i = 2 \text{ and } r_{(i+2)mod n} = 2 \text{ and } (c_{(i+2)mod n} - c_i) = 1 \text{ and } r_{(i+1)mod n} = 3 \\ 0 & \text{otherwise} \end{cases}$$

The explanations given so far describes the basic, 'default' way of operation of the method.

Options/Variations of Usage

The method also involves the possibility of working with the additional options described below, in addition to the basic (default) operation which aims to optimize the representation of the whole scale.

Usage Option No. 1: It is based on solving the spelling of the scale so as to represent its beginning/first pitch (root) in the simplest (minimum accidental) condition.

The option to prioritize the simple representation of the first pitch in the solution is provided as follows:

First, all the possible paths are generated.

If the first element of the input is 0, 2, 4, 5, 7, 9 or 11, all the paths which do not locate this element in the middle row of the matrix are eliminated.

If the first element is not equal to one of these values, when it is 1 or 6, all the paths which locate the first element in the bottom row of the matrix and when it is 3 or 10, all the paths which locate the first element in the top row of the matrix are eliminated.

Then, the process continues with the first stage and the following stages like the basic operation.

Usage Option No. 2: it is based on solving the spelling of the scale so that it will be represented by a preselection of one of the various possible representations of the beginning pitch (root).

The procedure in this option is as follows:

The user specifies the first pitch's preferred location in the matrix (two possible locations for pitch-class number 8, and three for each of the other eleven).

After all possible paths are generated, all the paths which do not begin with the preferred matrix coordinate are eliminated.

Then, the process continues with the first stage and the following stages like the basic operation.

Usage Option No. 3: It is based on solving the scale so that it will have the representation closest to the previous solution ('the winner').

The procedure in this option is as follows:

After an input is given at least once, matrix coordinates of the winning path are recorded. If there is more than one winner, the user chooses the winner whose representation will be used.

After all possible paths for the new input are generated, the process continues with the first stage and the following stages like the basic operation, with the paths which have the maximum number of locations—disregarding their order in the scale—common with the locations of the previous solution.

Usage Option No. 4: It is based on solving the scale so that it will have the representation closest to some preselected pitch representations.

This operation is provided as follows:

The user chooses all locations they prefer to be used in the matrix beforehand. After all possible paths are generated, the process continues with the first stage and the following stages like the basic operation, with the paths which have the maximum number of locations common with these locations.

Usage Option No. 5: It is based on solving the scale so that it will represent the descending scale instead of the ascending scale representation in the basic (default) operation.

This operation is provided as follows:

The ascending order of the scale is used without any change in all the stages in the basic (default) operation. The only difference, since it consists of favoring the paths having a flat sign instead of a sharp sign between naturals, is fulfilled by replacing 3 with 1 in the condition checked in the fifth stage. Thus, the entire condition for this option is as follows:

$$P_{stage_5} = \max_{P_{stage_4}} \left\{ \sum_{i=1}^{n} \theta_i \right\}$$

$$\theta_i = \begin{cases} 1 & r_i = 2 \text{ and } r_{(i+2)mod n} = 2 \text{ and } (c_{(i+2)mod n} - c_i) = 1 \text{ and } r_{(i+1)mod n} = 1 \\ 0 & \text{otherwise} \end{cases}$$

The winner paths are shown with their elements arranged in reverse order.

Usage Option No. 6: It is based on solving the scale so that it will be shown in mixed order instead of the ascending scale representation in the basic (default) operation.

This operation is provided as follows:

First, the elements (e1, e2, . . . , en) from the entry list the user gave in the mixed order are sorted into an ascending list and rotated until the first element of the original mixed order entry is placed at the beginning (s1=e1). The ascending list obtained this way, equivalent to the ascending scale in the basic (default) operation is again used in all stages without any change. In order to investigate the different condition in the option, when the fifth stage is reached, if the condition $$r_i=2 \text{ and } r_{(i+2)mod\ n}=2 \text{ and } (c_{(i+2)mod\ n}-c_i)=1$$

is not met, the winners are shown in the original mixed order. If it is met, for the indices u, v, w of eu, ev and ew elements which are equal to si, s(i+1)mod n and s(i+2)mod n respectively, the paths which meet the condition $$((u<v<w) \text{ or } (u<w<v) \text{ or } (v<w<u)) \text{ and } r(i+1) \bmod n=3 \quad \text{(sharp)}$$

and the paths which meet the condition $$\text{not}((u<v<w) \text{ or } (u<w<v) \text{ or } (v<w<u)) \text{ and } r(i+1) \bmod n=1 \quad \text{(flat)}$$

get preference points. The winner path(s) are shown in the original mixed order.

The invention can be carried out as software or hardware in the technological systems which involve any kind of musical application in which musical scales take place. For example; a typical application is showing the notation on the screen (belonging to a computer or another hardware that can be designed) comprising the representation calculated by the subject method, of a scale (this input can also be given as pitch numbers only) played by using a MIDI connected musical instrument (such as a digital piano or a synthesizer).

The invention claimed is:

1. A method for spelling pitches of any musical scale, comprising:

in a first stage, searching a path using a maximum number of different columns of a matrix;

in a second stage, searching a path including a minimum number of augmented or diminished musical intervals by choosing a path or a plurality of paths having a lowest score after calculating a penalty score by finding extreme intervals through an investigation of an interval type between each two elements of each path;

in a third stage, determining a preference of the path or the plurality of paths including a representation of a maximum number of natural pitches;

in a fourth stage, determining a preference of the path or the plurality of paths including a minimum number of double flats and double sharps; and in a fifth stage, checking whether, or not, paths having pitches with a sharp sign between two naturals exist, wherein the two naturals are two semitones apart from each other.

2. The method according to claim 1, wherein maximum two elements are chosen on a same matrix column.

3. The method according to claim 1, wherein if two elements are chosen on a same matrix column, the two elements are adjacent to each other.

4. The method according to claim 1, wherein the method further comprises the following operation steps which are to be implemented before the first stage, with the purpose of solving a first pitch of the musical scale so as to represent the first pitch in a simplest way, generating all possible paths;

if a first element of an input is 0, 2, 4, 5, 7, 9 or 11, eliminating all the paths which do not locate the first element in a middle row of the matrix; and if the first element is not any one selected from the group consisting of 0, 2, 4, 5, 7, 9 and 11, eliminating all possible paths which locate the first element in a bottom row of the matrix when the first element is 1 or 6, and eliminating all paths which locate the first element in a top row of the matrix when the first element is 3 or 10.

5. The method according to claim 1, wherein the method further comprises the following operation steps which are to be implemented before the first stage with the purpose of solving a first pitch of the musical scale so as to be represented by a preselection of one of a plurality of possible representations of the first pitch, in the matrix, specifying a location preferred for the first pitch as one of two locations for pitch class number 8 or one of three locations for other eleven pitches; and after all possible paths are generated, eliminating all paths which do not begin with a preferred matrix coordinate.

6. The method according to claim 5, wherein the method further comprises the following operation steps which are to be implemented before the first stage with the purpose of solving the musical scale so as to be in a closest representation, recording a matrix coordinate of a winner path following a submittal of an input at least once;

wherein the path or the plurality of paths include most common locations with the locations disregarding their order in the musical scale, after all possible paths are generated for a new input.

7. The method according to claim 1, wherein the method further comprises the following steps which are to be implemented before the first stage with the purpose of solution so as to be in a closest representation with preselected pitch representations, choosing all locations preferred to be used in the matrix beforehand;

wherein, the path or the plurality of paths include most common locations with the locations, after all possible paths are generated.

8. The method according to claim 1, wherein the method further comprises the following operation steps which are to be implemented after the fifth stage with the purpose of solving the musical scale so as to show a descending scale representation instead of an ascending scale representation in a basic (default) manner of operation, giving preference points to $r_{(i)}=2$ and $r_{(i+2)mod\ n}=2$ and $(c_{(i+2)mod\ n}-c_{(i)})=1$ and $r_{(i+1)mod\ n}=1$ condition so that in the fifth stage, as a difference, paths in which pitches marked as flat instead of sharp between the natural pitches are preferred; and listing winner paths with elements of the winner paths arranged in a reverse order.

9. The method according to claim 1, wherein the method further comprises the following operation steps with the purpose of solving the musical scale so as to show a mixed scale representation instead of an ascending scale representation in a basic (default) manner of operation, sorting elements from an entry list $(e_1, e_2, \ldots, e_n)$ a user have given in a mixed order into an ascending order and rotating so that a first element of an original mixed order input will be at a beginning $(s_1=e_1)$;

for the entry list obtained in this manner, using an ordered list increasing equivalently with the ascending scale in the basic (default) operation of the first to fifth stages;

when the fifth stage is reached, showing winners in the original mixed order if the $r_{(i)}=2$ and $r_{(i+2)mod\ n}=2$ and $(c_{(i+2)mod\ n}-c_{(i)})=1$ condition is not met;

if the $r_{(i)}=2$ and $r_{(i+2)mod\ n}=2$ and $(c_{(i+2)mod\ n}-c_{(i)})=1$ condition is met, for indices of $e_u$, $e_v$ and $e_w$ elements which are equal to $s_i$, $s_{(i+1)mod\ n}$ and $s_{(i+2)mod\ n}$ respectively, giving preference points to paths which meet a condition of $$((u<v<w) \text{ or } (u<w<v) \text{ or } (v<w<u)) \text{ and } r_{(i+1)mod\ n}=3 \qquad \text{(sharp)}$$

and to paths which meet a condition of $$\text{not}((u<v<w) \text{ or } (u<w<v) \text{ or } (v<w<u)) \text{ and } r_{(i+1)mod\ n}=1 \qquad \text{(flat); and}$$

showing a winner path(s) in the original mixed order.

10. A method of using of the method according to claim 1, comprising using the method in technological systems comprising any kind of musical application.

* * * * *